United States Patent [19]

Choy

[11] Patent Number: 4,867,895

[45] **Date of Patent: * Sep. 19, 1989**

[54] TIMED-RELEASE BLEACH COATED WITH AN AMINE WITH REDUCED DYE DAMAGE

[75] Inventor: Clement K. Choy, Walnut Creek, Calif.

[73] Assignee: The Clorox Company, Oakland, Calif.

[ * ] Notice: The portion of the term of this patent subsequent to Mar. 1, 2005 has been disclaimed.

[21] Appl. No.: 106,536

[22] Filed: Oct. 7, 1987

Related U.S. Application Data

[63] Continuation of Ser. No. 2,806, Jan. 13, 1987, Pat. No. 4,728,453.

[51] Int. Cl.[4] ..... C11D 3/395; C11D 3/30; C11D 17/06

[52] U.S. Cl. ..... 252/91; 252/102; 252/174.13; 252/186.34; 252/186.35; 252/525; 252/544; 427/214; 427/220

[58] Field of Search ..... 252/102, 91, 174.13, 252/186.34, 186.35, 544, 525; 427/220, 214

[56] References Cited

U.S. PATENT DOCUMENTS

| | | | |
|---|---|---|---|
| 2,695,274 | 11/1954 | MacMahon | 252/99 |
| 3,036,013 | 5/1962 | Jaszka et al. | 252/99 |
| 3,629,124 | 12/1971 | King | 252/99 |
| 3,640,875 | 2/1972 | Rubin et al. | 252/99 |
| 3,893,954 | 7/1975 | Tivin et al. | 252/548 |
| 3,983,254 | 9/1976 | Alterman et al. | 428/403 |
| 4,005,029 | 1/1977 | Jones | 252/99 |
| 4,078,099 | 3/1978 | Mazzola | 427/213 |
| 4,124,734 | 11/1978 | Alterman et al. | 428/403 |
| 4,126,573 | 11/1978 | Johnston | 252/99 |
| 4,136,052 | 1/1979 | Mazzola | 252/94 |
| 4,150,965 | 4/1979 | Van Hijfte et al. | 71/27 |
| 4,193,888 | 3/1980 | McHugh | 252/99 |
| 4,207,197 | 6/1980 | Davis et al. | 252/99 |
| 4,219,435 | 8/1980 | Biard et al. | 252/90 |
| 4,279,764 | 7/1981 | Brubaker | 252/99 |
| 4,309,299 | 1/1982 | Rapisarda et al. | 252/95 |
| 4,327,151 | 4/1982 | Mazzola | 428/407 |
| 4,375,416 | 3/1983 | Crisp | 252/8.7 |
| 4,421,664 | 12/1983 | Anderson et al. | 252/94 |
| 4,537,697 | 8/1985 | Girard | 252/90 |
| 4,560,755 | 12/1985 | Hidaka et al. | 544/363 |
| 4,560,766 | 12/1985 | Girard et al. | 548/311 |
| 4,615,816 | 10/1986 | Tai | 252/8.8 |
| 4,648,979 | 3/1987 | Parslow | 252/8.8 |
| 4,675,124 | 6/1987 | Seiter | 252/91 |
| 4,707,160 | 11/1987 | Chun | 8/101 |
| 4,713,079 | 12/1987 | Chun et al. | 8/101 |

FOREIGN PATENT DOCUMENTS 2148340A 5/1985 United Kingdom .

OTHER PUBLICATIONS

Texaco Chem. Co., "Jeffamine M-300", 1981, pp. 1-2.
Texaco Chem. Co., "Jeffamine M-Series", 1981.
Texaco Chem. Co., "M-300 Series Exper. Surfactants", 1981, pp. 1-2.
Sherex, "Adogen Fatty Amines, Diamines, and Amides", (undated), pp. 1-8.
Armak, "Phys. & Chem. Char. of Armeen Aliphatic Amines", pp. 1-10, 1983.

*Primary Examiner*—A. Lionel Clingman
*Assistant Examiner*—Kathleen Markowski
*Attorney, Agent, or Firm*—Majestic, Parsons, Siebert & Hsue

[57] ABSTRACT

Delayed-release hypohalite bleach compositions are provided which include encapsulates having a granular, hypohalite-releasing core and a coating delaying release of hypohalite ion and scavenging hypohalite ion when the encapsulates are exposed to an aqueous solution. The coating must include an amine compound with limited solubility in water. The core preferably includes a dihalodialkyl hydantoin and the coating an amine having a saturated hydrocarbon carbon of about 6 to about 24 carbon atoms.

8 Claims, No Drawings

TIMED-RELEASE BLEACH COATED WITH AN AMINE WITH REDUCED DYE DAMAGE

This is a continuation of application Ser. No. 002,806, filed Jan, 13, 1987, now U.S. Pat. No. 4,728,453, issued Mar. 1, 1988.

FIELD OF THE INVENTION

The present invention relates generally to halogen bleach compositions, and more particularly relates to timed-release hypohalite bleach compositions with reduced dye damage.

BACKGROUND OF THE INVENTION

Halogen-releasing bleach compositions are generally recognized as having greater oxidizing power than other bleach agents such as peroxygen compositions. Bleaches which release hypochlorite or hypobromite ion are particularly effective, as is known in the art.

Because hypohalite-releasing bleaches are such effective oxidants, however, problems may arise during use. Fabric and dye damage may result from locally high concentrations of hypochlorite or hypobromite if the dry bleach is not diluted with wash water prior to introduction of fabrics or if undissolved bleach granules settle on fabrics subsequent to laundering. Additionally, chlorine and other halogen bleaches are incompatible with some laundry additives such as enzymes and optical brighteners, since strong oxidizing agents can render these additives ineffective.

Several solutions have been proposed to counter these problems. One proposed solution to the problem of enzyme degradation in particular is the introduction of a chlorine scavenger into a bleach composition in order to delay the release of chlorine into the wash water. In U.S. Pat. No. 3,893,954 to Tivin et al., for example, a hydroxyamine compound is added to an enzyme-containing detergent to react with residual chloride. Another proposed solution to the problem of fabric damage caused by high chlorine concentration is the addition of diluents to the dry bleach which are admixed, compacted and granulated with the bleach itself. U.S. Pat. No. 4,309,299 to Rapisarda et al. shows, for example, the admixture and compaction of diluents such as succinates and citrates with chlorine bleaches to improve chlorine retention characteristics. Stabilizers such as potassium carbonate have also been used, as taught in U.S. Pat. No. 2,695,274 to MacMahon et al.

Another approach to solving the problems caused by excess hypochlorite in solution is encapsulation of the bleach. Encapsulation techniques are known for both peroxygen and chlorine bleaches. U.S. Pat. No. 4,126,573 to Johnston, for example, shows the encapsulation of a peroxyacid bleach with a water-soluble surfactant compound. Several patents teach the use of coatings derived from fatty acids, such as U.S. Pat. No. 4,327,151 to Mazzola, which discloses an encapsulated bleaching agent having an inner coating of a fatty acid and a microcystalline wax, and an outer coating of a fatty acid and Pluronic surfactants, and U.S. Pat. No. 3,983,254 to Alterman, which shows a method of encapsulating bleaching agents with fatty acids and alkali metal salts of fatty acids. Other encapsulated bleaches are also known. For example, U.S. Pat. No. 4,279,764 to Brubaker shows encapsulation of a mixture of an organic nitrogen-containing halogen bleachings agent, an N-H containing compound, and a soluble inorganic hydratable salt. U.S. Pat. No. 3,036,013 to Jaszka teaches an encapsulated calcium hypochlorite bleach. While the inventions of these patents share the same characteristic of encapsulation, they vary as to temperature dependence, shelf stability, and most importantly, as to the timing of the bleach release.

In order to provide an effective timed-release bleach, not only must hypochlorite release into aqueous solution be delayed, but the timing for complete release into solution must also be controlled. That is, even where the solubility of the encapsulate coating is selected such that hypochlorite release is delayed, complete release must in addition be accomplished before the end of the wash cycle to avoid settling of bleach capsules on fabric. Such settling could case fabric and dye damage. This problem has been found, for example, with some coated calcium hypochlorite bleaches. Elimination of the problem requires a coating with appropriate solubility characteristics and one which will not interact with the bleach granules in a way that is inhibitory to the dissolution process.

It is also desirable to provide a bleach that in addition to having superior timed-release characteristics, also has good storage life, is effective over a broad range of concentrations, and is also effective over a broad range of temperatures.

SUMMARY OF THE INVENTION

Accordingly, it is an object of the present invention to provide a shelf-stable halogen bleach composition which minimizes fabric and dye damage while facilitating the inclusion of other desirable laundry additives such as enzymes and optical brighteners.

Further objects and advantages of the invention will become apparent to those skilled in the art upon examination of the specification and appended claims, as well as in the practice of the present invention.

In one aspect of the present invention, a bleach composition comprises a hypohalite bleaching agent encapsulated with a coating selected such that desirable timed-release characteristics are provided. Preferred bleaching agents are halogen-sustituted hydantoin compounds, and particularly preferred bleaching agents are the dihalodialkyldantoins.

Preferred coatings are those which delay release of the encapsulated bleaching agent and which can additionally scavenge available hypohalite ion in solution. Substantially water-soluble inorganic salts as the first, or inner, coating serve to retard dissolution of the bleaching agent by increasing ionic strength, and alkali metal sulfates in particular provide the desired timed-release characteristics. An amine compound having limited solubility in water must be used to encapsulate the hypohalite bleaching agent, preferably as a second, or outer, coating, superposed on the inner, sulfate coating. The outer amine coating includes a long carbon chain which lowers solublity, while the basic amino moiety scavenges hypohalite ion in solution.

DETAILED DESCRIPTION OF THE INVENTION

Compositions in accordance with the present invention have two essential components: a hypohalite-releasing bleaching agent core; and, a coating encapsulating the core which provides a several desirable functions. The primary purpose of encapsulation is to delay release of hypohalite ion into aqueous solution so that the probability of localized high concentrations of chlorine or bromine is minimized. At the same time, it is desired that release of hypohalite into solution be complete prior to the end of the wash cycle so that settling of the hypohalite granules on fabrics is prevented. To accomplish these purposes, the solubility of the coating in water must be limited. The coating must also be selected so that it does not interact with the bleaching agent in a way that is inhibitory to release in aqueous solution.

In a preferred embodiment of the invention, a bleach composition compositions a coated hyphalite-releasing bleaching agent, such a calcium or lithium hypochlorite, a halogenated isocyanurate or a halogen-substituted hydantoin. Such bleaching agents are known to the art and a number of chlorine releasing agents are disclosed in U.S. Pat. No. 3,983,254, issued Sept. 28, 1976, inventors Alterman et al., incorporated herein by reference. Preferably, the bleaching agent is a halogen-substituted hydantoin compound, and most preferably is a dihalodialkylhydantoin having the structural formula

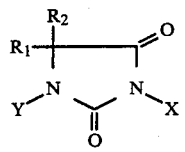

where $R_1$ and $R_2$ are alkyl substituents and X and Y are halogen substituents. $R_1$ and $R_2$ may be, for example, methyl, ethyl, propyl, or iso- or t-butyl. In particularly preferred hydantoin compounds, $R_1$ is methyl, $R_2$ is either methyl or ethyl, X is chlorine, and Y is either chlorine or bromine. Oxidation may thus be effected by either hypochlorite or hypobromite ion. The hypohalite releasing bleaching agent forms a granular core for the encapsulates. The particle size of the granular core preferably ranges from about 10μ to about 500μ.

Halogen-substituted hydrantoins are preferred due to their generally lower solubility and greater sensitivity to ionic strength. Thus, the inventive coating is particularly beneficial when applied to hydantoins.

Some suitable particularly preferred dihalodialkylhydantion compounds are illustrated in U.S. Pat. No. 4,560,755, issued Dec. 24, 1985, inventors Girard et al., incorporated herein by reference. Such dihalodialkylhydantoins, forming the granular core for the encapsulates, may include a solubilizing agent in an amount sufficient to increase the amount of total and free halogen of the granular core (once the coating encapsulating the core is removed during the washing cycle). such solubilizing agents are disclosed in 4,537,697, issued Aug. 27, 1985, inventor Girard, incorporated herein by reference.

Preferred delay times, providing adequate time for wash water to fill a machine, range from 1 to 5 minutes. Preferred time for complete release is on the order of 15 minutes or less, so that there will be no residual hypochlorite granules settling on fabric after completion of the wash cycle. Delay and complete release times vary with temperature; a high temperature results in a shorter delay time as well as in a shorter time for complete release. Delay and complete release times also vary with the amount of coatings applied, e.g. thicker coatings will result in a longer delay time and in a longer time for complete release.

The delay characteristics are provided by the coating. In the preferred embodiments, the hydantoin bleach core is preferably coated with a substantially water-soluble, inorganic salt. Preferred compounds thus include salts such as potassium chloride, potassium sulfate, sodium chloride, sodium sulfate, lithium chloride, lithium sulfate, and hypohalite-stable phosphate salts. Alkali metal sulfate salts are particularly preferred, and of these, sodium sulfate has been found to be especially effective. The amount of sulfate coating used preferably ranges from about 0.5 to about 50 wt. % relative to the weight of the encapsulate; more preferably, the amount ranges from about 5 to about 30 wt. %; still more preferably, from about 10 to about 25 wt. %. Exceptionally good results are obtained with a sulfate coating of about 20 wt. %. This substantially watersoluble inorganic salt assists in delaying release of the bleaching agent by increasing the ionic strength in the presence of aqueous solution.

The hydantoin bleach core must be encapsulated using partially soluble aliphatic or alkylaryl amine compounds, preferably over the inner, inorganic salt coating. Preferred amine compounds are those which can initially scavenge available hypochlorite in solution and which act to delay active hypohalite release. Selected amine compounds must have a limited solubility in water; the preferred solubility of the amine in water, in order to provide the desired timed release characteristics, ranges from about 0.001 wt. % to about 10 wt. % at 25° C., more preferably 0.001 wt. % to 5 wt. %. Where the solubility in water is quite low, it is preferred either to include a surfactant in formulations of the invention or to utilize the timed-release bleach in conjunction with laundry adjuvants such as detergents. Suitable surfactants include a wide variety of cationic, anionic, nonionic, and other compounds, preferably from about 1:20 to about 20:1 with respect to the encapsulates.

Anionic surfactants (generally also present in commercially available detergents) may be employed. Examples of such anionic surfactants include ammonium, substituted ammonium (for example, mono-, di-, and triethanolammonium), alkali metal and alkaline earth metal salts of $C_6$–$C_{18}$ fatty acids and resin acids, linear and branched alkyl benzene sulfonates, alkyl sulfates, alkyl ether sulfates, alkane sulfonates, olefin sulfonates, hydroxyalkane sulfonates, acyl sarcosinates and acyl N-methyltaurides.

Nonionic surfactants include linear ethoxylated alcohols, such as those sold by Shell Chemical Company under the brand name NEODOL. Other nonionic surfactants include various linear ethoxylated alcohols with an average length of from about 6 to 16 carbon atoms and averaging about 2 to 20 moles of ethylene oxide per mole of alcohol; linear and branched, primary and secondary ethoxylated, propoxylated alcohols with an average length of about 6 to 16 carbon atoms and averaging 0 to 10 moles of ethylene oxide and about 1 to 10 moles of propylene oxide per mole of alcohol; linear and branched alkylphenoxy (polyethoxy) alcohols, otherwise known as ethoxylated alkylphenols with an average chain length of 8 to 16 carbon atoms and averaging 1.5 to 30 moles of ethylene oxide per mole of alcohol; and mixtures thereof.

Additional nonionic surfactants include certain block copolymers of propylene oxide and ethylene oxide, block polymers propylene oxide and ethylene oxide with propoxylated ethylene diamine, and semi-polar nonoxides, phosphine oxides, sulfoxides, and their ethoxylated derivatives.

Suitable cationic surfactants include the quaternary ammonium compounds in which typically one of the groups linked to the nitrogen atom is a $C_8$–$C_{18}$ alkyl group and the other three groups are short chained alkyl groups which may bear inert substituents such as phenol groups.

Further, suitable amphoteric and zwitterionic surfactants, which may contain an anionc watersolubilizing group, a cationic group and a hydrophobic organic group, include amino carboxylic acids and their salts, amino dicarboxylic acids and their salts, alkylbetaines, alkyl aminopropylbetaines, sulfobetaines, alkyl imidazolinium derivatives, certain quaternary ammonium compounds and certain tertiary sulfonium compounds. Other examples of potentialy suitable zwitterionic surfactants can be found in Jones, U.S. Pat. No. 4,005,029, at columns 11–15, which are incorporated hereinby reference.

Other exemplary emulsifiers include water soluble or dipersible polymers, such as polyvinyl alcohol (PVA), polyvinylpyrrolidone (PVP), methylhydroxypropylcellulose (MHPC), etc. as well as bile and other natural emulsifiers.

The amine should include a saturated hydrocarbon chain having at least about five (5) carbon atoms. Preferred amine compounds for practice of the present invention are primary amines having the formula $RNH_2$, where R is a hydrocarbon substituent having between about six (6) and about twenty-four (24) carbon atoms, and includes branched chains, aryl groups, and alkoxy groups. Secondary amines having the desired solubility profile may also be used. Particularly preferred amines are surface active, which assists in detergency removal during use. Examples of particularly preferred amines for practice of the present invention include dodecylamine ($C_{12}H_{25}NH_2$), stearyl amine, oleyalmine ($C_{18}H_{35}NH_2$), and long chain ethoxylated amines. One such long chain ethoxylated amine has the structure illustrated by Formula I.

$$R(OCH_2\underset{\substack{|\\ CH_3}}{C}H)_x-OCH_2\underset{\substack{|\\ CH_3}}{C}HNH_2 \qquad \text{Formula I}$$

where R is a mixture of alkyl groups from about 10 to 12 carbons, and x is an average of 1. The Formula I amine is available from Texaco Chemical Company under the mark "Jeffamine" M-300. Other amines in the Jeffamine M series are also suitable (e.g. M-360, M-600, M-1000), as are the poly(oxyethylene) diamines of the ED series. Illustrative suitable amines also are cocoamine, hexadecylamine ($C_{16}H_{33}NH_2$), octadecylamine ($C_{18}H_{37}NH_2$), and the diamines thereof. An exemplary diamine is dicocoamine. Tertiary amines are possible for use, but less preferred.

The amount of amine coating used preferably ranges from about 0.5 wt. % to about 50 wt. % relative to the weight of the encapsulate, more preferably is about 1 wt. % to about 25 wt. % and most preferably is about 10 wt. %.

One coating procedure for the preferred dual coating is as follows. A dry source of hypohalite is first coated with a compound such as sodium sulfate. Then a fatty amine such as dodecylamine (e.g., such as manufactured by Armak Industrial Chemicals Co., Chicago, Illinois, under the name "ARMEEN") is placed in a solvent such as perchloroethylene in an amount sufficient to provide a saturated solution (a 1:1 wt./wt. ratio of amine to perchloroethylene is typical) and sprayed onto or poured over the salt-coated hypohalite. The solvent is then evaporated by air- drying.

Encapsulation may, however, be effected using any of a number of methods known in the art. For example, the method used to provide the compositions of the present invention may be a spray encapsulation method, such as described by U.S. Pat. No. 3,983,254, inventors Alterman, issued Sept. 28, 1976, incorporated herein by reference, whereby the hypohalite- releasing bleaching agent to be encapsulated is uniformly coated with a spray flow of the appropriate coating.

A primary advantage of encapsulation is the reduction in dye and fabric damage resulting from locally high concentrations of hypohalite ion. Another equally important advantage of bleach encapsulation is the feasibility of including hypohalite-sensitive laundry additives, such as enzymes and optical brighteners, in a comprehensive bleach system. Since hypohalite can render enzymes and optical brighteners ineffective, the delay of bleach release (and hypohalite scavenging of the fatty amine) makes possible the action of enzymes and optical brighteners prior to release.

Enzymes known and useful as laundry additives include hydrolases, such as carbohydrases (amylases), proteases and esterases (lipases). Preferred proteases, which attack protein-based staines such as blood and grass stains, include alkaline proteases available from Novo Industri, Copenhagen, Denmark, under the trade names Savinase, Alcalase, and Esperase. Among the commercially available amylases are those which attack carbohydrate and starch-based stains, such as an amylase available from Societe Rapidase under the trade name of Rapidase, and from Miles Laboratories under the trade name of Milezyme.

Fluorescent whitening agents, also known as optical brighteners, or brighteners, are adsorbed by textile fibers and impart to the fabric an improved degree of whiteness or brightness (fluorescene) by means of their chemical ability to absorb ultraviolet radiation and reemit visible radiation, and have found widespread use as components of household detergent compositions. In order to provide substantial fabric whitening, it is desirable to combine the optical brightening capacity of fluorescent whitening agents with an effective bleach. Brighteners include compounds such a stilbene brighteners and their derivatives, styrylnaphthalene brighteners and their derivatives and styrene brighteners and their derivatives. Particularly suitable compounds include the disodium salt of 2,2-(4,4'-biphenylene divinylene)dibenzenesulfonic acid (manufactured and sold under the name Tinopal CBS-X by Ciba-Geigy Corporation of Greensboro, North Carolina) and Phorwhite BHC 766 (manufactured by Mobay Corporation of Union, New Jersey). Alkaline earth, alkali metal, zinc, and other multivalent salts (such as the metals of Groups IIIA of the Periodic Table of the Elements) of these compounds are also suitable brightening agents.

Such enzymes and brighteners may effectively be included in a halogen bleach composition providing that there is a sufficient delay in release time. The encapsulation structure of the present invention makes possible the inclusion of sensitive enzymes and brighteners in a hypochlorite or hyprobromite bleach composition.

The encapsulated bleach of the present invention is effective over a wide range of available hypohalite concentrations. As a composition used to reduce dye and fabric damage, preferred concentrations (e.g. available chlorine) range from about 1 to about 200 ppm, and particularly preferred concentrations range from about 5 to about 30 ppm.

The present invention also encompasses a method of reducing dye damage during fabric bleaching, using the above-described hydantoin encapsulates. The method involves dissolving encapsulated hydantoin bleach in an aqueous solution at a temperature of from about 4 to about 55° C. in the presence of detergent and in an amount sufficient to provide a concentration of bleaching agent ranging from about 1 to about 80 ppm. Fabrics are contacted with the bleach solution for at least 2 minutes. A particularly preferred temperature range is from about 21 to about 55° C., and a particularly preferred bleach concentration ranges from about 1 to about 20 ppm.

The following examples illustrate certain embodiments of the present invention, and are not intended to limit the scope of the invention as described in the appended claims.

EXAMPLE I

Preparation of Sodium Sulfate-Coated Hydantoin

A sodium sulfate coated 1,bromo-3,chloro-5,5-dimethylhydantoin bleach composition was prepared as follows. A 25 wt. % aqueous solution of sodium sulfate was prepared. Two hundred grams of the hydantoin Glyco GSD-560 obtained from Glyco, Inc., Greenwich, Connecticut, were then encapsulated with the sodium sulfate solution in an Aeromatic Spray Granulator, with a solution spray rate of about 10 g. per min. and a spray time of approximately 20 min. The encapsulates were dried at about 65° C. for about 1 min. before addition of the second coating.

EXAMPLE II

Preparation of Dual Coated Hydantoin

The initially prepared, sodium sulfate-coated 1,bromo-3,chloro-5,5-dialkylhydantoin of Example I (20% by weight coating of sodium sulfate; 50.4% active chlorine) was then coated with a long chain amine, Armeen, a dodecylamine (manufactured by Armak Industrial Chemical Company, Chicago, Illinois) in a 1:1 wt./wt. ratio of amine to perchloroethylene. The fatty amine was placed in perchloroethylene in sufficient quantity (1:1 wt./wt. ratio) to make a saturated solution. Then 25 g of the sodium-sulfate coated encapsulated of Example I was combined with 50 ml of the saturated solution of fatty amine in perchoroethylene by placing the encapsulates on cheesecloth and pouring the saturated fatty amine solution over the encapsulates. The solvent is then evaporated by air drying. The amount of amine present in the dual coated hydantoin particles of the invention was 10 wt. %.

EXAMPLE III

Chemical Stability of Encapsulated Dihalodialkylhydantoin

The 1,bromo-3,chloro-5,5-dimethylhydantoin is normally 63% active with a theoretical value of 50.4% available chlorine. The dual coated 1,bromo-3,chloro-5,5-dimethydantoin of Example II was then stored for two weeks at 49° C. Thereafter, the encapsulated dihalodialkylhydantoin was dissolved in water and 50.34% available chlorine was calculated to be present via titration with sodium thiosulfate/potassium iodide solution.

In another sample of the inventive encapsulate containing 71.4% Glyco GSD-560, 17.9% sodium silicate and 10.7% Armeen, and prepared in a manner analogous to Example II, the level of available chlorine following was assayed to be 45.0%.

These data illustrate the continuing chemical stability of the inventive encapsulates.

EXAMPLE IV

A composition in accordance with the invention was prepared in a manner analogous to that described by Example II, where the inventive particles were 72 wt. % 1,bromo-3,chloro-5,5 methylhydantoin, 18 wt. % $Na_2SO_4$, and 10 wt. % Jeffamine M-300 long chain ethoxylated amine. A comparison composition was obtained from FMC Corporation containing NaDCC (sodium dichloroisocyanaurate) instead of hydantoin as hypohalite source, and instead of the fatty amine of the invention sulfamic acid was used in the outer coating. The comparison particles were 13.5 wt. % NaDCC, 6.8 wt. % sulfamic acid, 57.9 wt. % $Na_2C_3$ and 21.8% sodium silicate. A control composition, consisting of the uncoated hyantoin, was also utilized.

Samples of these three compositions (2 g each composition) were placed on nine different dyed cloth swatches which had been dampened with 100° F. water. The nine different dyed cloth swatches (three of each) were as follows:

| Dyed Cloth Swatch | |
|---|---|
| 1 | Delhi red (direct) on 100% cotton |
| 2 | Direct red 75 on 100% cotton |
| 3 | Disperse/reactive pink on 65:35 polyester/cotton |
| 4 | Calcutta green (disperse/direct) on 100% cotton |
| 5 | Reactive blue 109 on 100% cotton |
| 6 | Direct blue 80 on 100% cotton |
| 7 | Blue vat on 100% cotton |
| 8 | Disperse blue 3/reactive blue 109 on 65:35 polyester/cotton |
| 9 | Disperse blue 3/sodified blue B on 65:35 polyester/cotton |

The compositions were allowed to sit on the fabrics for 2 minutes. The fabrics were then rinsed and dried. The 27 cloth swatches were then evaluated visually for localized dye damage by evaluating the nine cloth swatches exposed to the control composition (uncoated hydantoin) on a scale of 0 to 5 (wherein "5" was no dye damage and "0" was total dye damage). The remaining 18 cloth swatches, exposed respectively to the inventive composition and to the comparison composition, were then evaluated as a percent reduction of the dye damage found from the respective nine control swatches. Table I, below, sets out the reduction of localized dye damage data for the invention and the comparison composition.

TABLE I

| Composition | Cloth Swatch No. 1 | 2 | 3 | 4 | 5 | 6 | 7 | 8 | 9 | Average over the 9 |
|---|---|---|---|---|---|---|---|---|---|---|
| Comparison (coated with sulfamic acid, $Na_2CO_3$ and sodium silicate) | 80% | 40% | 76% | 48% | 21% | 32% | 100% | 21% | 52% | 52% |
| Inventive (coated with $Na_2SO_4$ and long chain fatty amine) | 100% | 67% | 96% | 100% | 39% | 19% | 100% | 90% | 97% | 79% |

As may be seen by the data of Table I, the dual encapsulated hydantoin of the invention provided significantly reduced localized dye damage.

A particularly preferred, comprehensive bleach system was prepared having the composition illustrated in Table II, below.

TABLE II

| Preferred Embodiment | wt. % |
|---|---|
| Encapsulated Hypohalite | 2.22 |
| Sodium Carbonate | 95.72 |
| Sodium Perborate $4H_2O$ | 0.77 |
| Pigment | 0.10 |
| Optical Brightener | 0.09 |
| Surfactant | 0.25 |
| Enzyme | 0.75 |
| Perfume | 0.10 |

The comprehensive bleach, whose composition is illustrated by Table II, may be prepared as follows. The sodium carbonate, sodium perborate, enzyme (such as Esperase), and optical brightener (such as Tinopal 5B MXC) may be added to a Plexiglas chamber which is rotated to blend the ingredients for 10 min. The pigment, such as ultramarine blue, may be added and mixed for an additional 10 min. A mixture of the surfactant (such as Triton X-100) and fragrance may be sprayed onto the revolving mixer using an atomizing nozzle and then continuing to mix by rotating the chamber for another 2 min. The encapsulated hypohalite (prepared as described in Example II) may then be added as granules and the chamber rotated for an additional 5 min. If desired, the batch can be blended for an additional amount of time to ensure the particles, and particularly the ultramarine blue, are thoroughly dispersed.

While the invention has been described in connection while specific embodiments thereof, it will be understood that it is capable of further modifications, and this application is intended to cover any variations, uses or adaptations of the invention following, in general, the principles of the invention and including such departures from the disclosure as come within the known or customary practice in the art to which the invention pertains and as may be applied to the essential features hereinbefore set forth, and as fall within the scope of the invention and the limits of the appended claims.

I claim:

1. A granular laundering aid comprising: bleach encapsulates, the encapsulates having a hypohalite releasing agent core and a coating encapsulating the core, the coating effective to delay release of the hypohalite releasing agent when exposed to an aqueous solution and to scavenge hypohalite ion, the coating including a fatty amine with a solubility in water of from about 0.001 wt. % to about 5 wt. % at 25° C., the fatty amine in an amount from about 0.5 wt. % to about 20 wt. % with respect to the encapsulates; and, at least one laundering adjuvant selected from the group consisting of an effective amount of enzymes and optical brighteners.

2. The laundering aid as in claim 1 wherein the hypohalite releasing agent has the structure

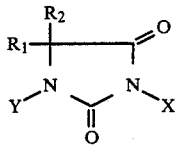

wherein $R_1$ and $R_2$ are methyl, ethyl, propyl or butyl substituents and X and Y are halogen substituents.

3. The laundering aid as in claim 2 wherein the fatty amine is in an amount of from about 0.5 wt. % to about 50 wt. % of the encapsulate.

4. The laundering aid as in claim 3 wherein the fatty amine has the formula $R_1NHR_2$, where $R_1$ is an alkyl or alkylaryl substituent having between about 6 to about 24 carbon atoms, and $R_2$ is hydrogen or a alkyl or alkylaryl substituent having between about 6 to about 24 carbon atoms.

5. The laundering aid as in claim 4 wherein the alkyl or alkylaryl substituent of $R_1$ or $R_2$ includes one or more alkoxy group(s).

6. The laundering aid as in claim 3 wherein the fatty amine is dodecylamine.

7. The laundering aid as in claim 3 further comprising a surfactant in a weight ratio with respect to the encapsulates of from about 1:20 to about 20:1.

8. The laundering aid as in claim 1 wherein the hypohalite releasing agent includes an isocyanurate, a hypochlorite or a hydantoin, and the fatty amine is in an amount from about 5 wt. % to about 30 wt. % of the encapsulate.

* * * * *

UNITED STATES PATENT AND TRADEMARK OFFICE

CERTIFICATE OF CORRECTION

PATENT NO. : 4,867,895

DATED : SEPTEMBER 19, 1989

INVENTOR(S) : CLEMENT K. CHOY

It is certified that error appears in the above-identified patent and that said Letters Patent is hereby corrected as shown below:

Column 10, line 21, in Claim 1: replace "20 wt." with --50 wt.--

Signed and Sealed this

Thirty-first Day of July, 1990

*Attest:*

*Attesting Officer*

HARRY F. MANBECK, JR.

*Commissioner of Patents and Trademarks*